US012240666B2

(12) United States Patent
Lenfers et al.

(10) Patent No.: US 12,240,666 B2
(45) Date of Patent: Mar. 4, 2025

(54) CUBOID FOLDING BOX

(71) Applicant: TRAPO AG, Gescher-Hochmoor (DE)

(72) Inventors: Daniel Lenfers, Billerbeck (DE); Martin Klier, Oldenburg (DE)

(73) Assignee: TRAPO AG, Gescher-Hochmoor (DE)

( * ) Notice: Subject to any disclaimer, the term of this patent is extended or adjusted under 35 U.S.C. 154(b) by 179 days.

(21) Appl. No.: 17/714,405

(22) Filed: Apr. 6, 2022

(65) Prior Publication Data

US 2022/0324606 A1 Oct. 13, 2022

(30) Foreign Application Priority Data

Apr. 9, 2021 (EP) ..... 21167549

(51) Int. Cl.
*B65D 5/54* (2006.01)
*B65D 5/20* (2006.01)

(52) U.S. Cl.
CPC ..... *B65D 5/5445* (2013.01); *B65D 5/2076* (2013.01)

(58) Field of Classification Search
CPC .... B65D 5/5445; B65D 5/5475; B65D 5/541; B65D 5/542; B65D 5/0227
USPC ..... 229/235, 240, 242, 112, 164; 206/736
See application file for complete search history.

(56) References Cited

U.S. PATENT DOCUMENTS 4,058,206 A 11/1977 Morse et al.
4,553,666 A * 11/1985 Gullikson ..... B65D 5/5445 229/115
8,474,688 B2 * 7/2013 Cameron ..... B65D 5/443 229/162.1
8,752,708 B2 * 6/2014 Keefe ..... B65D 5/5445 206/774
9,290,294 B2 * 3/2016 Laughman ..... B65D 5/542
9,994,356 B2 * 6/2018 Couture ..... B65D 5/0227
11,772,842 B2 * 10/2023 Lagrou ..... B65D 5/542 229/120.01
2005/0184139 A1 * 8/2005 Gasior ..... B65D 5/52 206/774
2010/0058717 A1 * 3/2010 Smith ..... B65D 5/321 53/461
2016/0009441 A1 1/2016 Gessler, Jr. et al.
(Continued)

*Primary Examiner* — Nathan J Newhouse
*Assistant Examiner* — Phillip D Schmidt
(74) *Attorney, Agent, or Firm* — Keating & Bennett, LLP

(57) ABSTRACT

A one-piece blank for a cuboid folding box includes five main panel segments arranged in a row and separated from one another on transverse sides via main fold lines, a second secondary panel segment adjoining a second main panel segment on a longitudinal side, including an edge, and adjoining the second main panel segment via a second secondary fold line, and a third secondary panel segment adjoining a third main panel segment on a longitudinal side via a third secondary fold line. The secondary fold lines are perpendicular to the main fold lines, a first perforation line extends over the third main panel segment and at least partially over the third secondary panel segments. The third secondary panel segments are each divided by the first perforation line into a first region adjacent to the second secondary panel segment and a second region adjacent to the fourth secondary panel segment. Shapes of the second secondary panel segments and a course of the first perforation line are such that, in a folded state, the second secondary panel segments overhang the first perforation line in a region of the third secondary panel segments.

19 Claims, 4 Drawing Sheets

(56) References Cited

U.S. PATENT DOCUMENTS

| | | | | |
|---|---|---|---|---|
| 2018/0118406 | A1 | 5/2018 | Weiss | |
| 2019/0009946 | A1* | 1/2019 | Nixon | B65D 5/4266 |
| 2019/0185201 | A1 | 6/2019 | McCarthy | |
| 2019/0344924 | A1 | 11/2019 | Gessler, Jr. et al. | |

* cited by examiner

CUBOID FOLDING BOX

CROSS REFERENCE TO RELATED APPLICATIONS

This application claims the benefit of priority to European Patent Application No. 21167549.1 filed on Apr. 9, 2021. The entire contents of this application are hereby incorporated herein by reference.

BACKGROUND OF THE INVENTION

1. Field of the Invention

The present invention relates to a one-piece blank for a cuboid folding box, and to a cuboid folding box and a method for producing a cuboid folding box.

2. Description of the Related Art

It is known to use cuboid folding cartons made of cardboard for secondary packaging of primary-packaged products, such as flexible packaging made of plastic, in particular, stand-up pouches or flow pack packaging. It is desirable for this secondary packaging to also be suitable for presenting the products on a sales shelf.

The cuboid of the cuboid folding box is formed by folding a blank. The blank usually has several panel segments separated from each other by fold lines forming the edges of the cuboid. Usually, a fastening tab forming one end of the blank is glued to an edge of an opposite panel segment, forming four circumferential side surfaces of the cuboid. Panel segments connected to the side surfaces of the cuboid by fold lines form the lid and/or the bottom of the cuboid, which can be closed by folding along the fold lines. For the presentation of goods, conventionally, a top part of the folding box is removed from a bottom part, the products remaining in the bottom part, so that the primarily packaged products do not have to be removed from the packaging by the sales personnel and the customer can access the products directly. To this end, it is known that folding boxes have perforations that enable a top part to be separated from a bottom part.

However, such secondary packaging needs improvement because the perforation points where the top has been separated from the bottom are visible to the customer on the shelf and do not present an appealing visual appearance.

SUMMARY OF THE INVENTION

Preferred embodiments of the present invention provide improved one-piece blanks for folding cardboard boxes, each of which makes it possible for only punched edges of the blank to be visible to customers after a top portion has been separated from a bottom portion.

Preferred embodiments of the present invention provide blanks for cuboid folding boxes, cuboid folding boxes, and methods for producing folding boxes.

According to a preferred embodiment of the present invention, a one-piece blank for a cuboid folding box includes five main panel segments arranged in a row and separated from one another by main fold lines on transverse sides, wherein a first main panel segment defines a first end of the blank and a second main panel segment adjoins the first main panel segment and a third main panel segment adjoins the second main panel segment and a fourth main panel segment adjoins the third main panel segment and a fifth main panel segment adjoins the fourth main panel segment, the fifth main panel segment defines a second end of the blank, and the main panel segments are foldable about the main fold lines, and a second secondary panel segment including an edge, adjoins the second main panel segment on a longitudinal side in each case over a second secondary fold line, a third secondary panel segment adjoins the third main panel segment on the longitudinal side in each case over a third secondary fold line, and the secondary fold lines are perpendicular to the main fold lines. Further, the blank includes a first perforation line extending across the third main panel segment and at least partially across the third secondary panel segments, wherein the third secondary panel segments are each divided into two regions by the first perforation line, a first region is a region adjacent to the second secondary panel segment and a second region is a region adjacent to the fourth secondary panel segment, and shapes of the second secondary panel segments and a course of the first perforation line are configured such that, in a folded state, the second secondary panel segments project beyond the first perforation line in a region of the third secondary panel segments. In the folded state, the first perforation line is below edges of the second secondary panel segments, so that when the box is detached along the perforation line, a resulting perforation edge is not visible in a side view of the sides defined by the second secondary panel segments. The term "overhang" is understood to mean that a tear-off edge at a separation point defined by the perforation line is covered.

In a preferred embodiment of the present invention, a second secondary fold line and a second main fold line separating the second main panel segment from the third main panel segment define an intersection point. x is a distance of a point on the second secondary fold line to the intersection point, wherein a height h of the second secondary panel segment is a function of x and the height h is a distance from the second secondary fold line to the edge of the adjacent second secondary panel segment at the point x. A width b of the third secondary panel segment, which is on the same side with respect to the longitudinal axis of the blank as the second secondary panel segment, in the first area is a function of y, respectively, where the width b is defined as the distance from a straight-line extension of the second main fold line to the perforation line, and y is the distance of a point on the straight-line extension of the second main fold line to the intersection point, where the following relationship is satisfied:

if $y=x$, then $b(y)<=0.98*h(x)$.

This can ensure that the edges of the second secondary panel segments protrude far enough beyond the first perforation line in the folded state.

Preferably $b(y)>=0.30*h(x)$, in particular $b(y)>=0.50*h(x)$.

It is advantageous if the two second secondary panel segments are equal, and especially symmetrical to a central axis (longitudinal axis of the blank).

The blank is preferably made of cardboard, and more preferably, corrugated cardboard. The cardboard preferably has a thickness of less than about 8 mm.

Preferably, the first perforation line is parallel or substantially parallel to the main fold lines. It is also possible for the first perforation line to take on any shape, e.g., a round shape or a parabola.

In order to simplify detachment in the folded state of the folding box, a first incision preferably adjoins the first perforation line in the region of the third main panel segment.

It is further advantageous if the fifth main panel segment includes an edge, a bonding area and a second perforation line at least partially surrounding the bonding area, and the first main panel segment includes an edge, a course of the second perforation line and of the edge of the first main panel segment being configured such that, in the folded state, the first main panel segment projects above the second perforation line. In the folded state of the folding box, the second perforation line thus is below the edge of the first main panel segment, so that when the box is detached along the perforation line, the resulting perforation edge is not visible in a front view of the front side defined by the first main panel segment.

The second perforation line preferably extends along the sides of the bonding area remote from the edge. The second perforation line can extend straight and parallel to the main fold lines above the bonding area. However, the second perforation line can also be arranged or configured differently. The second perforation line need only run along the sides of the bonding area remote from the edge so that it is possible to tear off and thus detach an upper portion from a lower portion of the folding box defined by the blank.

Preferably, the longitudinal sides of the fourth main panel segment are each adjoined by fourth secondary panel segments which have a shape corresponding to the second secondary panel segments in such a way that, in the folded state of the cuboid folding box, the second and fourth secondary panel segments have no overlap region. This makes it particularly easy to separate the upper portion from the lower portion of the folding box along the first perforation line.

It is preferred if the third secondary panel segments are divided into two separate areas by the first perforation line, the third secondary panel segments each including an incision at their edges which adjoins the ends of the first perforation line. The incisions shorten the first perforation line, facilitating the separation process.

Preferably, in each case, a distance between the incision and the third secondary fold line is in a range between about 20% and about 60% of a distance between the third secondary fold line and a portion of the edge of the third secondary panel segment extending parallel thereto.

The shape of the incision is preferably adapted to the course of the edge of the second secondary panel segment.

The one-piece blank is preferably dimensioned so that the first and third main panel segments have a distance between the adjacent main fold lines of about 50 mm to about 700 mm.

The one-piece blank is preferably dimensioned so that the first and third main panel segments have a width along the main fold lines that is in a range between about 60 mm and about 400 mm.

The one-piece blank is preferably dimensioned so that the third main panel segment has a distance between the adjacent main fold lines of about 40 mm to about 300 mm.

Furthermore, a cuboid folding box may be constructed from a previously described one-piece blank folded along the main fold lines and secondary fold lines. Preferably, the third side panel segments have outer sides thereof fixed or glued to inner sides of the second and fourth side panel segments. When the tabs are on the inside, this results in an improved appearance.

Preferably, the second and fourth secondary panel segments each include tabs on outer transverse sides, the outer sides of which are bonded to the corresponding inner side of the first main panel segment and the fifth main panel segment. However, the tabs of the fourth secondary panel segment may alternatively be fixed or glued to the outer side of the fifth main panel segment, since this is in the tear-off area and thus does not interfere with the appearance.

It is advantageous if the fifth main panel segment defines a second tab which is bonded with its outer side in the bonding area to the inner side of the first main panel segment or the inner sides of the third tabs adjoining the second secondary panel segment as a cover securing device. The fifth main panel segment can then be separated from the first main panel segment along the second perforation line.

In a preferred embodiment of the present invention, the two perforation lines allow the top portion to be separated from the bottom portion of the folding box, with the resulting tear-off edges being hidden by the first main panel segment and the second secondary panel segments in the front view and in the side views of the folding box.

The cuboid folding box preferably accommodates primary-packaged products arranged such that the packaged products can be removed from the lower portion via the front side of the folding box, which is defined by the first main panel segment. The first main panel segment preferably has, in a removal area, a maximum width (a maximum height of the front side of the lower portion) that is smaller than a minimum width of the first area of the third main panel segment (a minimum height of the rear side of the lower portion). Thus, it can be ensured that the primary-packaged products can rest against the rear side and can be easily removed towards the front.

Another preferred embodiment of the present invention provides a method of folding a cuboid folding carton including a one-piece blank described above, the method including folding in third secondary panel segments along third secondary fold lines by using an erector, applying adhesive to fourth secondary panel segments and second secondary panel segments (preferably the inner surfaces) or applying adhesive to the third secondary panel segments (preferably the outer surfaces), folding in the second and fourth secondary panel segments and the second and fourth main panel segments, bonding the second and fourth secondary panel segments (preferably the inner surfaces) to the third secondary panel segments (preferably the outer surfaces) via applied adhesive, loading products into the folding box open at a top portion, and closing the folding box.

It is understood that during the folding processes or folding operations, the corresponding segments are folded inwards around the fold lines at an angle of about 90°+/−5°. The process enables the folding boxes to be filled from above through the open front side in the so-called top-loading process, which can be carried out quickly and easily with the aid of robot arms. The adhesive is preferably glue, which is preferably sprayed on.

Preferably, the second and fourth secondary panel segments each include a tab on an outboard (the transverse sides facing away from the third secondary panel segments) secondary fold line, and the method further includes folding in the tabs of the second and fourth secondary panel segments, applying adhesive to the fifth main panel segment, folding in the fifth main panel segment and applying adhesive to the first main panel segment (alternatively, the adhesive can be applied to the outside of the folded-in fifth main panel segment), and then folding in the first main panel segment and joining the inside of the first main panel segment to the outside of the fifth main panel segment via the applied adhesive.

However, the method may also include folding in the tabs of the fourth secondary panel segments, applying adhesive to the tabs of the fourth secondary panel segments or applying adhesive to the inside of the fifth main panel segment, folding in the fifth main panel segment and joining the inside of the tabs of the fourth secondary panel segments to the fifth main panel segment via the applied adhesive, applying adhesive to the outside of the fifth main panel segment, and then folding in the tabs of the second secondary panel segments and joining the inside of the tabs of the second secondary panel segments to the fifth main panel segment via the applied adhesive, applying adhesive to the tabs of the second secondary panel segments or applying adhesive to the first main panel segment, and folding in the first main panel segment and joining the inner side of the first main panel segment to the outer sides of the tabs of the second secondary panel segments via the applied adhesive.

The method preferably includes, in further steps, separating an upper portion from a lower portion along the perforation lines.

Preferably, the method includes, after the separation, removing the products via the front side of the lower portion defined by the first main panel segment.

The above and other elements, features, steps, characteristics and advantages of the present invention will become more apparent from the following detailed description of the preferred embodiments with reference to the attached drawings.

BRIEF DESCRIPTION OF THE DRAWINGS

In the following, preferred embodiments of the present invention are explained in more detail with reference to the drawings. Identical components or components with identical functions bear identical reference signs.

DETAILED DESCRIPTION OF THE PREFERRED EMBODIMENTS

Figure 1:
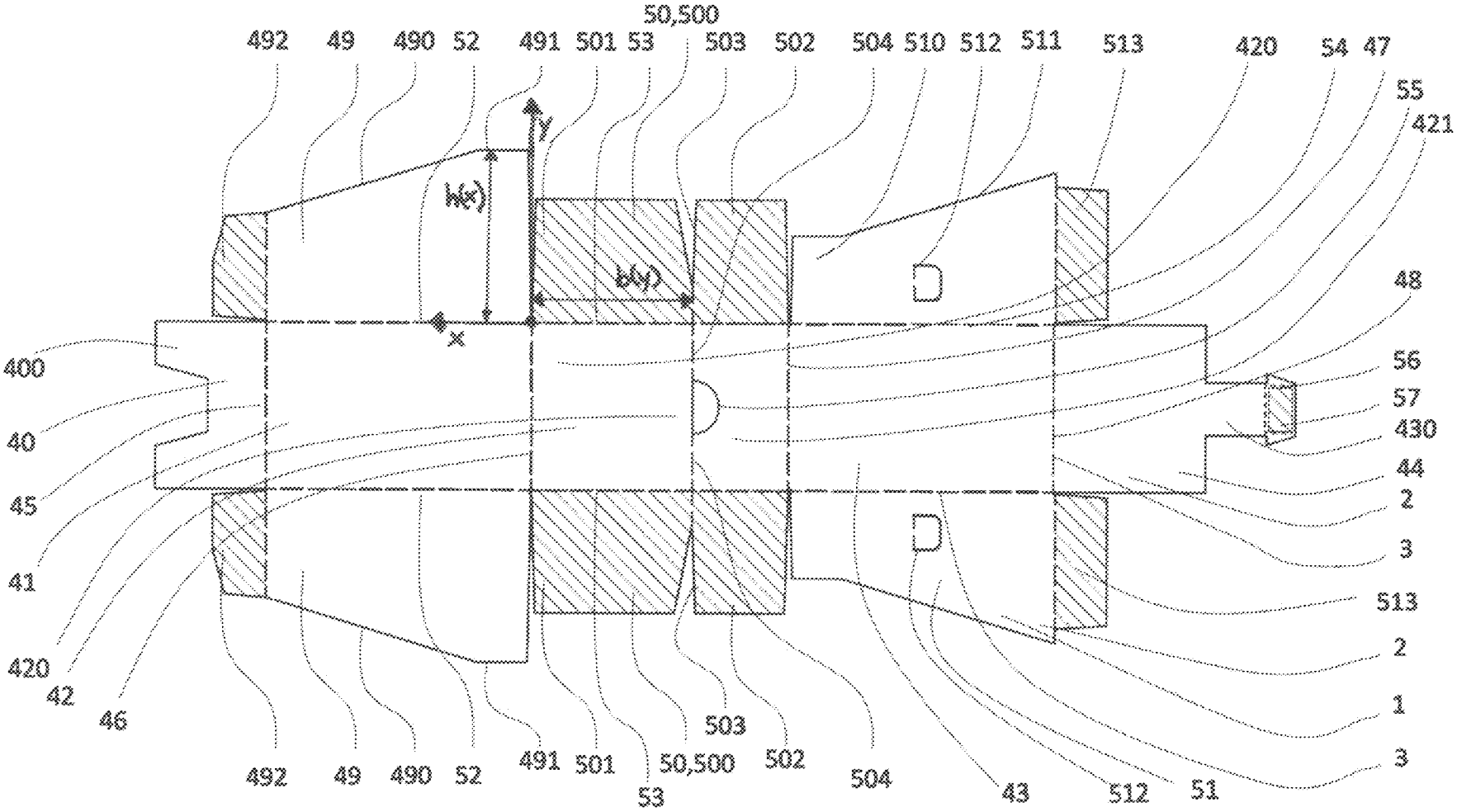
FIG. 1 shows a top view of a blank of a cuboid folding box.

FIG. 1 shows an exemplary blank 1 of a cuboid folding box with a plurality of panel segments 2. The panel segments 2 are separated from one another by fold lines 3. Five main panel segments 40,41,42,43,44 are provided, which adjoin one another at the transverse sides and are folded at main fold lines 45,46,47,48 to one another at an angle of about 90°. The main panel segments 40,41,42,43,44 define a front wall, a rear wall, a lid and a bottom of the cuboid folding box. The first main panel segment 40 is a first tab 400 that is part of the front wall and defines a front portion of the folded folding box. A first main fold line 45 separates the first main panel segment 40 from the adjacent second main panel segment 41, which defines the bottom portion. A second main fold line 46 separates the second main panel segment 41 from the adjoining third main panel segment 42, which defines a rear wall of the folding box. Again adjoining the third main panel segment 42 is a fourth main panel segment 43, which are separated by a third main fold line 47. The fourth main panel segment 43 defines the lid. The sizes of the second and fourth main panel segments are identical or substantially identical except for a deduction due to the cardboard thickness of the tabs. The fourth main panel segment 43 is joined by a fifth main panel segment 44 via a fourth main fold line 48. The fourth main panel segment 43 is also part of the front wall and includes a second tab 430, which in the folded state of the folding box is located behind the first tab 400, on the inside. The second tab 430 may be glued directly behind the first tab 400, or indirectly connected to the first tab 400 by being glued to the inner side of secondary surfaces, as will be described later. In both variants, the first and second tabs 400,430 are firmly connected to each other preferably by bonding. Adhesive bonding as lid securing can be dispensed with. Adjacent to the second, third and fourth main panel segments 41,42,43 on both sides on the long sides are secondary panel segments 49,50,51 via secondary fold lines 52,53,54 which are perpendicular to the main fold lines 45,46,47,48. The secondary panel segments 49,50,51 define the side walls. The secondary panel segments 49,50,51 opposite each other with respect to the main panel segments are each identical or substantially identical. Adjacent to the second main panel segment 41 are second secondary panel segments 49. The two second secondary panel segments 49 each include a linearly beveled edge 490, wherein the height of the second secondary panel segments 49 increases in the direction of the third main panel segment 42 and has a constant height at the end in an end region 491. The edge 490 may also have a curved shape, for example. The end region 491 extends over about 20% of the width of the second main panel segment 41, but the second secondary panel segments 49 may also have other edge shapes. A third tab 492 extends from each of the two second secondary panel segments 49, each of which is defined by an extension of the first main fold line 45. The third tabs 492 thus are located laterally of the first main panel segment 40, but have no direct connection thereto. In the folded state of the folding box, the two third tabs 492 lie behind the first tab 400 and are bonded thereto. Depending on how the second tab 430 is formed, it may be that the second tab 430 is not directly glued to the first tab 400, as mentioned above, but only indirectly via the third tabs 492. In this case, the first tab 400 and the third tabs 492 are dimensioned and formed in such a way that the customer sees only the first tab 400 as a front view and the third tabs 492 disappear behind it, out of view. Third secondary panel segments 50 are laterally connected to the third main panel segment 42 by third secondary fold lines 53. The third secondary panel segments 50 have no direct connection to the second secondary panel segments 49. The third secondary panel segments 50 each define a fourth tab 500, the outer side of which is bonded to the inner side of the associated side wall. The fourth tabs 500 each include an edge that is straight and parallel to the secondary fold line 53. They are divided into two regions 501,502, a first region 501 being a region adjacent to the second secondary panel segment 49 and extending over a width of about 60% of the total width of the third main panel segment 42, and being adjoined by a second region 502 over a width of about 40%. The two regions 501,502 are each defined by a incision 503 on the edge of the third secondary panel segment 50 extending in an area parallel to the main fold lines 45,46,47,48 and a first perforation line 504 connecting the incisions 503. The height of the incisions 503 is about 50% of the total height of the third secondary panel segment 50 in the region including the parallel edge. The incisions 503 are triangular in shape, with the acute angle on the inside. The first perforation line 504 thus extends across the two third secondary panel segments 50 and the third main panel segment 42, and also separates the third main panel segment 42 into a first region 420 and a second region 421 analogous to the third secondary panel segments 50. However, the incisions 503 corresponding to the design of the second and fourth secondary surfaces may be omitted. Centered on the first perforation line 504, at the center of the third main panel segment 42, a semi-circular indentation 55 is provided to be pressed into an interior of the folding carton about the first perforation line. This indentation 55 faces the fourth main panel segment and is provided to engage the rear wall of the folded folding box. The first perforation line 504 defines a top portion and a bottom portion of the folding box. The bottom portion is defined by the first and second main panel segments 40,41 and the first portion of the third main panel segment 420 and the second secondary panel segments 49 and the first portion of the third secondary panel segments 501 and the third tabs 492. In the folded state of the folding box, the upper portion can be separated from the lower portion in the rear region by the first perforation line 504 for the presentation of goods.

Fourth secondary panel segments 51 are laterally adjacent to the fourth main panel segment via fourth secondary fold lines 54. The fourth secondary panel segments 51 have no direct connection to the third secondary panel segments 50. The fourth secondary panel segments 51 have a constant height in a first area 510, which is about 20% of the width of the fourth main panel segment 43. This is followed by a linearly sloped edge 511, with the height of the fourth secondary panel segments 51 increasing in the direction of the fourth main panel segment 44. The shape of the fourth secondary panel segments 51 corresponds to the shape of the second secondary panel segments 49 which together form the side walls. Provision may be made both for the two secondary panel segments 49,51 to overlap or to be spaced apart by a gap at the edge. In this case, the edges can be adapted to the desired lateral appearance for the presentation of the goods. In the present preferred embodiment, the fourth secondary panel segments 51 have semicircular incisions 512 arranged approximately in the center of the width, which incisions 512 can be bent about a fold line and can thus be angled into the interior space formed by the folding box and assume a supporting function when the folding box is loaded. A fifth tab 513 extends from each of the two fourth secondary panel segments 51, each of which is defined by an extension of the fourth main fold line 48. The fifth tabs 513 thus are located laterally of the fifth main panel segment 44, but have no direct connection thereto. In the folded state of the folding carton, the two fifth tabs 513 are located internally behind the second tab 430 and are bonded thereto. In order to now separate the upper portion including the second area of the third main panel segment 421, the second regions 502 of the third secondary panel segments, as well as the fourth and fifth main panel segments 43,44 and the fourth secondary panel segments 51 including the fifth tabs 513 from the lower portion, a second perforation line 56 is formed on the second tab 430 around the bonding area 57. To present the merchandise on the shelf, the second tab 430 is depressed inwardly and separated at the second perforation line 56. The bonding area 57 and the second perforation line 56 are arranged in such a way that they are located below the edge of the first tab 400, the front view, in this area and are concealed by the first main panel segment. The tear-off edge provided on the second tab 430 as a result of the separation is therefore not visible to the viewer of the folding box standing on the shelf in the front view. In the next step, the upper portion is separated from the lower portion in the region of the rear wall by engaging in the centrally located incision 55 and detaching along the first perforation line 504. The upper portion can then be completely removed from the lower portion. In the folded state of the folding box, the first perforation line 504 is located below the edge of the second secondary panel segment 49 in the end region 491, so that the first tear-off edge formed during separation in the end region 491 is projected upwards from the edge of the side walls and the tear-off edge disappears behind the edge of the side walls and is concealed by the side walls.

The following describes a preferred embodiment of the second and third secondary panel segments and the first perforation line based on FIG. 1.

The second secondary fold line 52 and the second main fold line 46 separating the second main panel segment 41 from the third main panel segment 42 define an intersection. x is the distance of a point on the second secondary fold line to the intersection point. The height h of the second secondary panel segment 49 is a function of x, and the height h is the distance from the second secondary fold line 52 to the edge of the second secondary panel segment 49 at the point x. In each case, the width b of the third secondary panel segment 50 in the first region 501 is a function of y, where the width b is defined as the distance from a straight-line extension of the second main fold line 46 to the perforation line 504 and y is the distance of a point on the straight-line extension of the second main fold line 46 to the intersection point. Preferably, the following relationship is satisfied:

if $y=x$, then $b(y)<=0.98*h(x)$.

In this way, it can be ensured that along the edge of the second secondary panel segments, the secondary panel segments always overlap the perforation line.

Figure 2:
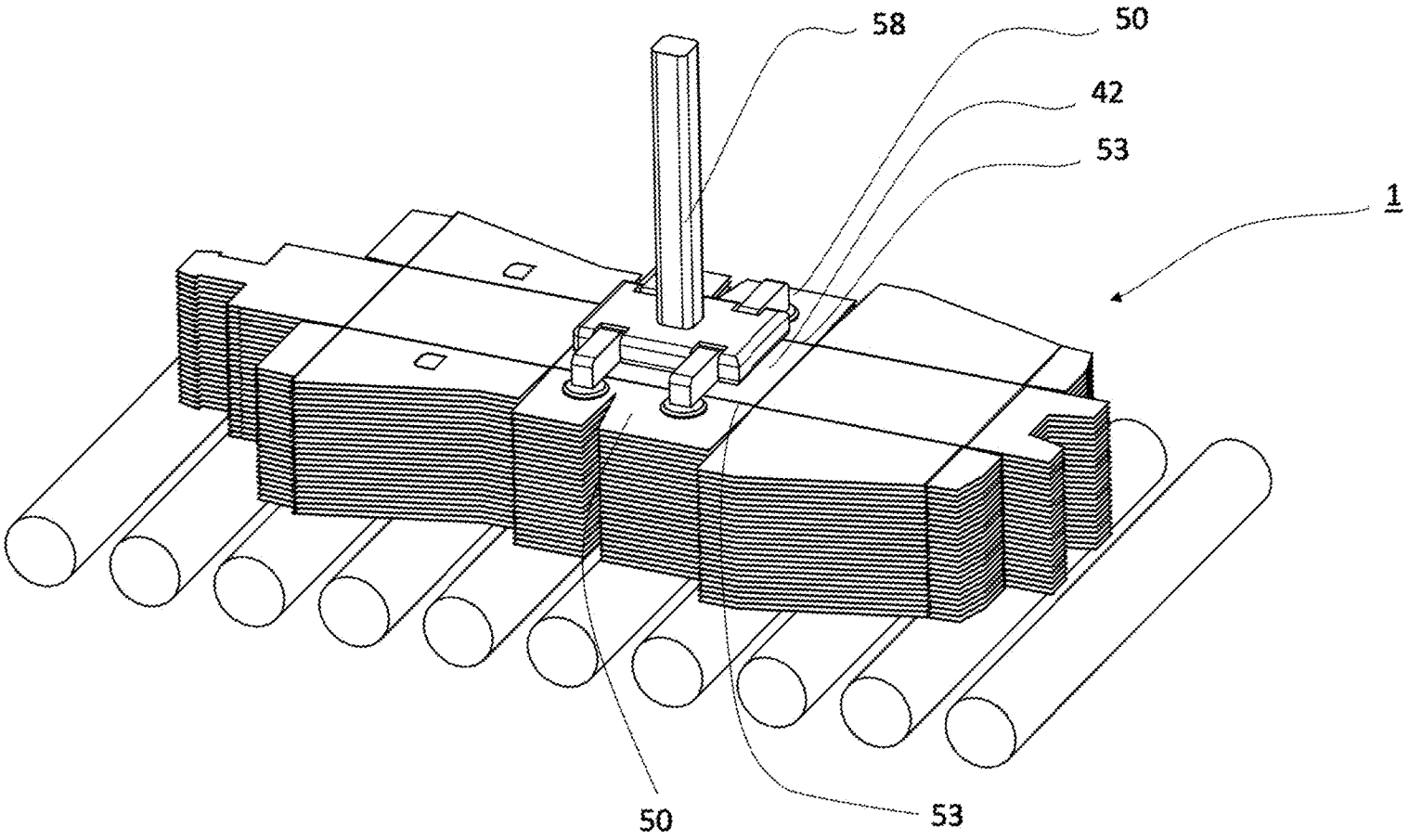
FIG. 2 shows a spatial view of the blanks in an erector.
Figure 3:
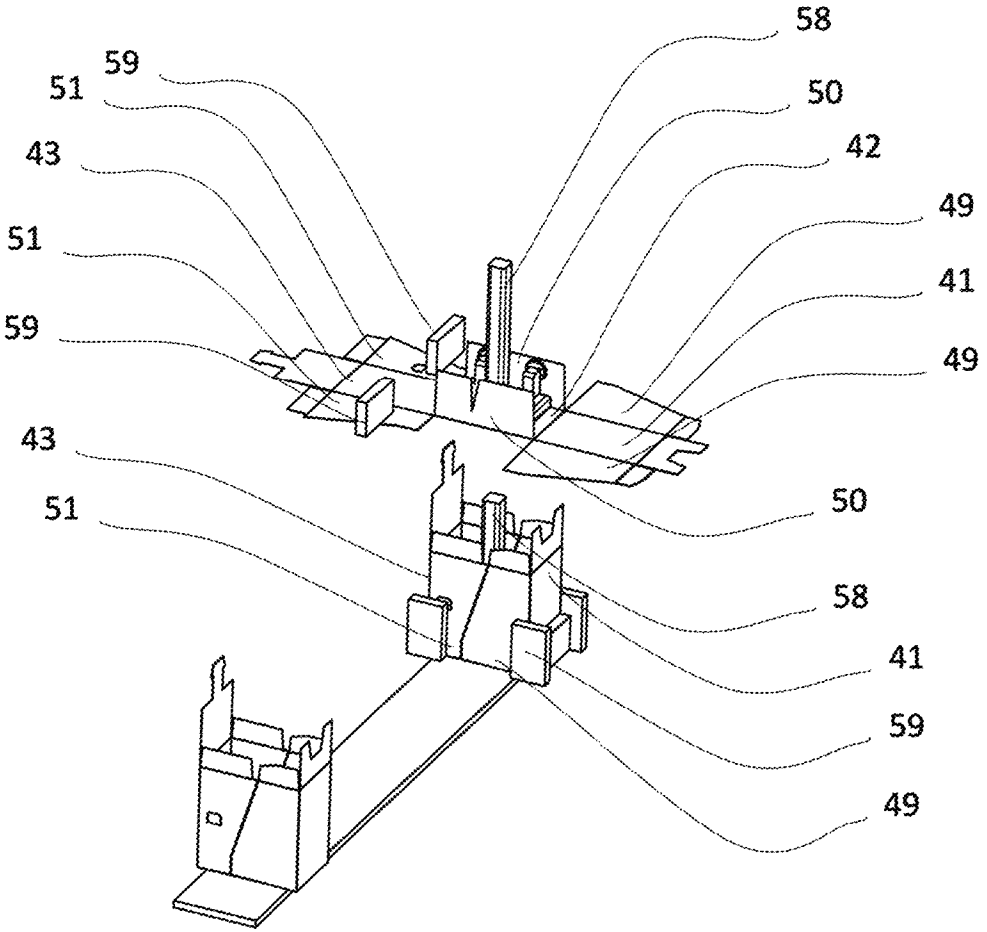
FIG. 3 shows a schematic representation of the folding process of the erector.
Figure 4:
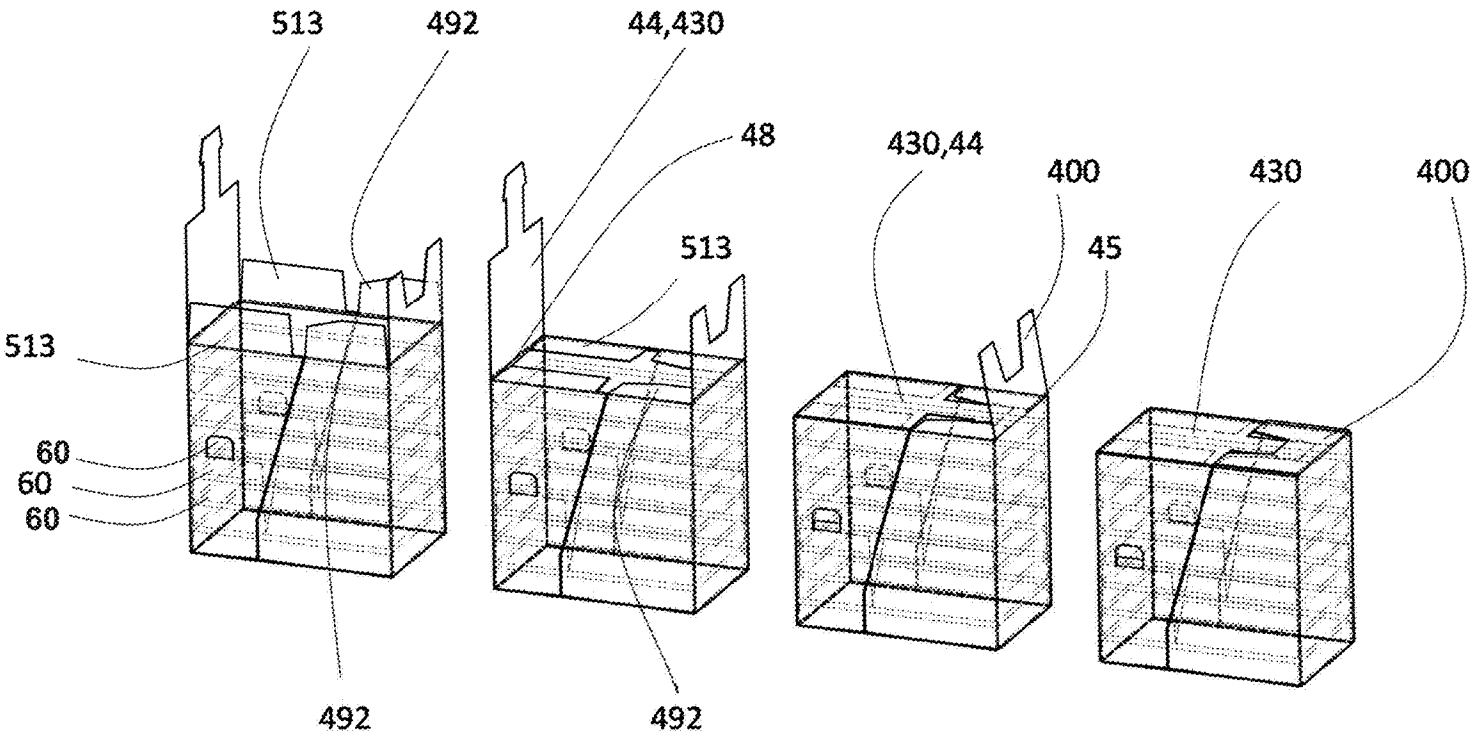
FIG. 4 shows a schematic representation of the closing process of a filled folding box.

The folding process of the cuboid folding box is explained with reference to FIGS. 2 to 4. FIG. 2 shows an infeed of blanks 1 stacked on top of each other into an erector. A blank pickup 58 grips the third main panel segment 42 from above and folds the third secondary panel segments inward along the third secondary fold lines 53. As shown in FIG. 3, glue is applied to the inside surfaces of the fourth secondary panel segments 51 via glue heads 59. The same happens with the inner sides of the second secondary panel segments 49, but the adhesive can also be applied to the opposite side, the third secondary panel segment 50. The blank pickup 58 is then lowered and, by inserting the third main panel segment 42 into a forming tray 59, the second and fourth secondary panel segments 49,51 and the second and fourth main panel segments 41,43 are folded inwardly about the corresponding fold lines. The adhesive bonds the inside surfaces of the second and fourth secondary panel segments 51,49 to the outside surfaces of the third secondary panel segments 50. The forming shells 59 are then removed and the erected folding box is transported out of the erector. The folding box is open at the top. The front side is oriented upwards and the front wall is thus not yet formed. In this state, the folding box is automatically loaded with primary-packed products, such as flexible packaging made of plastic, in particular stand-up pouches or flow packs, as shown in FIG. 4. The products 60 are stacked in the folding box. Thereafter, the folding box is closed in the area of the front and the front wall is formed. For this purpose, the third and fifth tabs 492,513 are folded in first. In the next step, the fifth main panel segment 44 or the second tab 430 is folded in around the fourth main fold line 48, and in a final step, the first tab 400 is folded inwards around the first main fold line 45. As already described above, the first tab 400 and the second tab 430 are firmly connected to each other.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A one-piece blank for a cuboid folding box, the one-piece blank comprising:

five main panel segments arranged in a row and separated from one another on transverse sides via main fold lines; wherein a first main panel segment defines a first end of the blank;

a second main panel segment adjoins the first main panel segment;

a third main panel segment adjoins the second main panel segment;

a fourth main panel segment adjoins the third main panel segment;

a fifth main panel segment adjoins the fourth main panel segment;

the fifth main panel segment defines a second end of the blank;

the five main panel segments are foldable about the main fold lines;

a second secondary panel segment, including an edge, adjoins the second main panel segment on a longitudinal side;

a third secondary panel segment adjoins the third main panel segment on a longitudinal side via a third secondary fold line;

secondary fold lines are perpendicular or substantially perpendicular to the main fold lines;

the secondary fold lines are arranged perpendicularly or substantially perpendicular to the main fold lines;

a first perforation line extends over the third main panel segment and at least partially over the third secondary panel segment;

the third secondary panel segment is divided by the first perforation line into a first region adjacent to the second secondary panel segment and a second region adjacent to a fourth secondary panel segment;

a shape of the second secondary panel segment and a course of the first perforation line are configured such that, in a folded state, the second secondary panel segment overhangs the first perforation line in a region of the third secondary panel segment;

a second secondary fold line and a second main fold line separating the second main panel segment from the third main panel segment define an intersection point;

x is a distance of a first point on the second secondary fold line to the intersection point and a distance of a second point on a straight-line extension of the second main fold line to the intersection point;

h is a perpendicular distance from the second secondary fold line to an edge of the second secondary panel segment at the first point;

b is a perpendicular distance from a straight-line extension of the second main fold line to the first perforation line at the second point; and a following relationship is satisfied: for each x that defines first and second points that define b and b, $b \leq 0.98h$.

2. The one-piece blank according to claim 1, wherein the first perforation line is parallel or substantially parallel to the main fold lines.

3. The one-piece blank according to claim 1, wherein a first incision adjoins the first perforation line in a region of the third main panel segment.

4. The one-piece blank according to claim 1, wherein the fifth main panel segment includes an edge, a bonding area, and a second perforation line at least partially surrounding the bonding area;

the first main panel segment includes an edge;

a course of the second perforation line and of the edge of the first main panel segment being configured such that, in the folded state, the first main panel segment projects beyond the second perforation line.

5. The one-piece blank according to claim 1, wherein fourth secondary panel segments, which have a shape corresponding to the second secondary panel segments, adjoin longitudinal sides of the fourth main panel segment such that, in the folded state, the second and fourth secondary panel segments do not have an overlapping region.

6. The one-piece blank according to claim 1, wherein the third secondary panel segments are divided into two separate areas by the first perforation line; and each of the third secondary panel segments includes an incision at an edge that adjoins an end of the first perforation line.

7. The one-piece blank according to claim 6, wherein a distance between the incision and the third secondary fold line is between about 20% and about 60% of a distance between the third secondary fold line and a portion of the edge of the third secondary panel segment extending parallel or substantially parallel thereto.

8. The one-piece blank according to claim 6, wherein a shape of the incision corresponds to a course of the edge of the second secondary panel segment.

9. The one-piece blank according to claim 1, wherein the first and third main panel segments have a distance between adjacent main fold lines of about 50 mm to about 700 mm.

10. The one-piece blank according to claim 1, wherein the second and fourth main panel segments have a width along the main fold lines between about 60 mm and about 400 mm.

11. The one-piece blank according to claim 1, wherein the third main panel segment has a distance between adjacent main fold lines of about 40 mm to about 300 mm.

12. A cuboid folding box comprising the one-piece blank according to claim 1 folded along the main fold lines and secondary fold lines.

13. The cuboid folding box according to claim 12, wherein the fifth main panel segment includes a second tab with an outer side glued in a bonding area to an inner side of the first main panel segment or to inner sides of third tabs adjoining the second secondary panel segment.

14. The cuboid folding box according to claim 12, wherein the first and second perforation lines enable a top portion to be separated from a bottom portion of the folding box such that resulting perforation edges are concealed by the first main panel segment and the second secondary panel segments in front and side views.

15. A method of folding a cuboid folding box including the one-piece blank according to claim 1, the method comprising:

folding in the third secondary panel segments along the third secondary fold lines by using an erector;

applying adhesive to the fourth secondary panel segments and the second secondary panel segments or applying adhesive to the third secondary panel segments;

folding in the second and fourth secondary panel segments and the second and fourth main panel segments;

bonding the second and fourth secondary panel segments to the third secondary panel segments using the adhesive;

loading products into a top of the folding box; and closing the folding box.

16. The method of claim 15, wherein the second and fourth secondary panel segments each include a tab at an outboard secondary fold line and the method further comprises:

folding in the tabs of the second and fourth secondary panel segments;

applying adhesive to the fifth main panel segment;

folding in the fifth main panel segment and applying adhesive to the first main panel segment; and folding in the first main panel segment and joining an inside of the first main panel segment to an outside of the fifth main panel segment via the adhesive.

17. The method of claim 15, wherein the second and fourth secondary panel segments each include a tab at an outboard secondary fold line and the method further comprises:

folding in the tabs of the fourth secondary panel segments;

applying adhesive to the tabs of the fourth secondary panel segments or applying adhesive to an inside of the fifth main panel segment;

folding in the fifth main panel segment and bonding the inside of the tabs of the fourth secondary panel segments to the fifth main panel segment via the adhesive;

applying adhesive to an outer surface of the fifth main panel segment;

folding in the tabs of the second secondary panel segments and bonding an inside of the tabs of the second secondary panel segments to the fifth main panel segment via the adhesive;

applying adhesive to the tabs of the second secondary panel segments or applying adhesive to the first main panel segment; and folding in the first main panel segment and joining an inner side of the first main panel segment to outer sides of the tabs of the second secondary panel segments via the adhesive.

18. The one-piece blank according to claim 1, wherein the first perforation line only extends through portions of the third main panel segment and the third secondary panel segments.

19. A cuboid folding box comprising: five main panel segments separated from one another on transverse sides via main fold lines; wherein a first main panel segment defines a first end of a one-piece blank; a second main panel segment adjoins the first main panel segment; a third main panel segment adjoins the second main panel segment; a fourth main panel segment adjoins the third main panel segment; a fifth main panel segment adjoins the fourth main panel segment; the fifth main panel segment defines a second end of the blank; the five main panel segments are foldable about the main fold lines; a second secondary panel segment, including an edge, adjoins the second main panel segment on a longitudinal side; a third secondary panel segment adjoins the third main panel segment on a longitudinal side via a third secondary fold line; secondary fold lines are perpendicular or substantially perpendicular to the main fold lines; the secondary fold lines are arranged perpendicularly or substantially perpendicular to the main fold lines; a first perforation line extends over the third main panel segment and at least partially over the third secondary panel segment; the third secondary panel segment is divided by the first perforation line into a first region adjacent to the second secondary panel segment and a second region adjacent to a fourth secondary panel segment; a shape of the second secondary panel segment and a course of the first perforation line are configured such that the second secondary panel segment overhangs the first perforation line in a region of the third secondary panel segment; outer sides of the third secondary panel segments are glued to inner sides of the second and fourth secondary panel segments; and each of the second and fourth secondary panel segments includes on an outer transverse side an outer side glued to an inner side of the first main panel segment and the fifth main panel segment.

* * * * *